US009108752B2

(12) United States Patent
Ponti

(10) Patent No.: US 9,108,752 B2
(45) Date of Patent: Aug. 18, 2015

(54) ENVELOPE-STUFFING MACHINE FOR STUFFING PILES OF ARTICLES IN SHEET FORM

(71) Applicant: C.M.C. S.r.l., Cerbara-Citta' diCastello (Perugia) (IT)

(72) Inventor: Francesco Ponti, Citta di Castello (IT)

(73) Assignee: C.M.C. S.r.l., Cerbara-Citta di Castello (Perugia) (IT)

( * ) Notice: Subject to any disclaimer, the term of this patent is extended or adjusted under 35 U.S.C. 154(b) by 0 days.

(21) Appl. No.: 14/358,342

(22) PCT Filed: Nov. 15, 2012

(86) PCT No.: PCT/IB2012/056465

§ 371 (c)(1),
(2) Date: May 15, 2014

(87) PCT Pub. No.: WO2013/072876

PCT Pub. Date: May 23, 2013

(65) Prior Publication Data

US 2014/0325939 A1 Nov. 6, 2014

(30) Foreign Application Priority Data

Nov. 16, 2011 (IT) ..... BO2011A0652

(51) Int. Cl.
*B43M 3/00* (2006.01)
*B65B 5/06* (2006.01)
(Continued)

(52) U.S. Cl.
CPC .. *B65B 5/06* (2013.01); *B43M 3/00* (2013.01); *B43M 3/04* (2013.01); *B43M 3/045* (2013.01);
(Continued)

(58) Field of Classification Search
CPC ..... B43M 3/00; B65G 21/14; B65B 5/06; B65B 7/02
USPC ..... 198/588, 594; 270/58.06; 53/237, 247, 53/266.1
See application file for complete search history.

(56) References Cited

U.S. PATENT DOCUMENTS

| | | | | |
|---|---|---|---|---|
| 4,274,623 | A * | 6/1981 | Reist et al. | 271/217 |
| 5,000,657 | A | 3/1991 | Gunther | |
| 7,475,522 | B2 * | 1/2009 | Ponti | 53/381.5 |

FOREIGN PATENT DOCUMENTS

| | | | |
|---|---|---|---|
| CN | 201580016 | U | 9/2010 |
| EP | 0478911 | A1 | 4/1992 |
| EP | 0932129 | A2 | 7/1999 |

*Primary Examiner* — Leslie A Nicholson, III

(74) *Attorney, Agent, or Firm* — R. Neil Sudol; Henry D. Coleman

(57) ABSTRACT

A stuffing machine (1) for stuffing piles (2) of sheet articles, comprising: a first conveyor (11) for moving piles (2) of sheet articles in a first advancement direction (A1); a second conveyor (12) arranged downstream of the first conveyor (11) with respect to the first advancement direction (A1), which second conveyor (12) is angularly arranged with respect to the first conveyor (11); a third conveyor (13) arranged downstream of the first conveyor (11) with respect to the first advancement direction (A1), which third conveyor (13) is aligned with the first conveyor (11), is extensible in a second advancement direction (A2) opposite the first advancement direction (A1), such as to assume an operating configuration (O) in which it passes over the second conveyor (12) and defines, with the first conveyor (11), a first conveying pathway (P1) and is retractable in a same direction as the first advancing direction (A1) in order to assume an inactive configuration (I) which enables the first conveyor (11) and the second conveyor (12) to define a second conveying pathway (P2); a first stuffing unit (3) positionable along the first conveying pathway (P1) for stuffing the piles (2) of sheet articles; a second stuffing unit (4) positionable along the second conveying pathway (P2) for stuffing the piles (2) of sheet articles.

10 Claims, 8 Drawing Sheets

(51) Int. Cl.

| | |
|---|---|
| ***B43M 3/04*** | (2006.01) |
| ***B65H 29/12*** | (2006.01) |
| ***B65H 29/60*** | (2006.01) |
| ***B65B 7/02*** | (2006.01) |

(52) U.S. Cl.

CPC *B65B 7/02* (2013.01); *B65H 29/12* (2013.01); *B65H 29/60* (2013.01); *B65H 2301/34112* (2013.01); *B65H 2404/2613* (2013.01); *B65H 2511/20* (2013.01); *B65H 2511/414* (2013.01)

ENVELOPE-STUFFING MACHINE FOR STUFFING PILES OF ARTICLES IN SHEET FORM

FIELD OF THE INVENTION

The present invention relates to the technical sector relating to machines for stuffing piles of articles in sheet form, such as letters, documents, publicity inserts.

DESCRIPTION OF THE PRIOR ART

Envelope stuffing machines are mainly used by companies whose business is stuffing and transmitting piles containing advertising or information from banks, post offices, telephone companies, public services, etc.

A stuffing machine of known type comprises a pile-forming station of sheet articles; this station in turn comprises: a conveyor for conveying the piles of sheet articles in formation; a plurality of sheet-placing devices, which are arranged laterally of the conveyor and each release one or more sheet articles on the pile under formation which is advancing on the conveyor. In outlet from the forming station the piles of articles in sheet form are arranged in rows and spaced from one another, ready to be stuffed.

The stuffing machine further comprises a stuffing unit which is arranged upstream of the forming station for stuffing the piles of articles in sheet form. At present two types of stuffing units are known. In accordance with a first type, a first stuffing unit envelopes the sheet articles with a paper strip supplied continuously, seals the paper strip with glue such as to envelop the articles and then successively cuts portions of the strip of paper in order to obtain envelopes each containing a pile of sheet articles.

According to a second type, a second stuffing unit inserts the piles of sheet articles in pre-formed envelopes and then seals the envelopes.

The stuffing machine obtained with the first stuffing machine is larger than the stuffing machine obtained with the second stuffing unit.

The pre-formed envelopes can be of high quality and/or exhibit specific characteristics, such as transparent windows or special ornaments; the envelopes can be chosen from among a wide range. The envelopes obtained with the first stuffing units are instead basic and more economical than the pre-formed envelopes.

A customer (for example a bank) can ask for basic envelopes to be used, being more economical, or pre-formed envelopes having specific characteristics; according to the customer's requirements it will be necessary to use respectively a stuffing machine provided with the first stuffing unit or a stuffing machine provided with the second stuffing unit.

In order to be able to satisfy any customer request, it will be necessary therefore to possess a stuffing machine provided with the first stuffing unit and a stuffing machine provided with the second stuffing machine. This involves high costs and occupation of space.

SUMMARY OF THE INVENTION

The aim of the present invention consists in obviating the above-cited drawbacks.

The aim is attained by means of a stuffing machine for pile-stuffing machines of sheet articles, according to claim 1.

The stuffing machine can advantageously comprise both the stuffing machines discussed herein above while using a single pile-forming station of sheet articles with a consequent saving in costs and space. The piles of sheet articles can be stuffed with the first stuffing unit or with the second stuffing unit, according to the customer's requirements; it is even possible to stuff automatically a quantity of piles of articles in sheet form with the first stuffing unit for a first group of addressees, and stuff a further quantity of piles of sheet articles with the second stuffing unit for a second group of addressees.

BRIEF DESCRIPTION OF THE DRAWINGS

Specific embodiments of the invention will be described in the following part of the present description, in accordance with what is set down in the claims and with the aid of the accompanying tables of drawings, in which:

DESCRIPTION OF THE PREFERRED EMBODIMENTS

Figure 1:
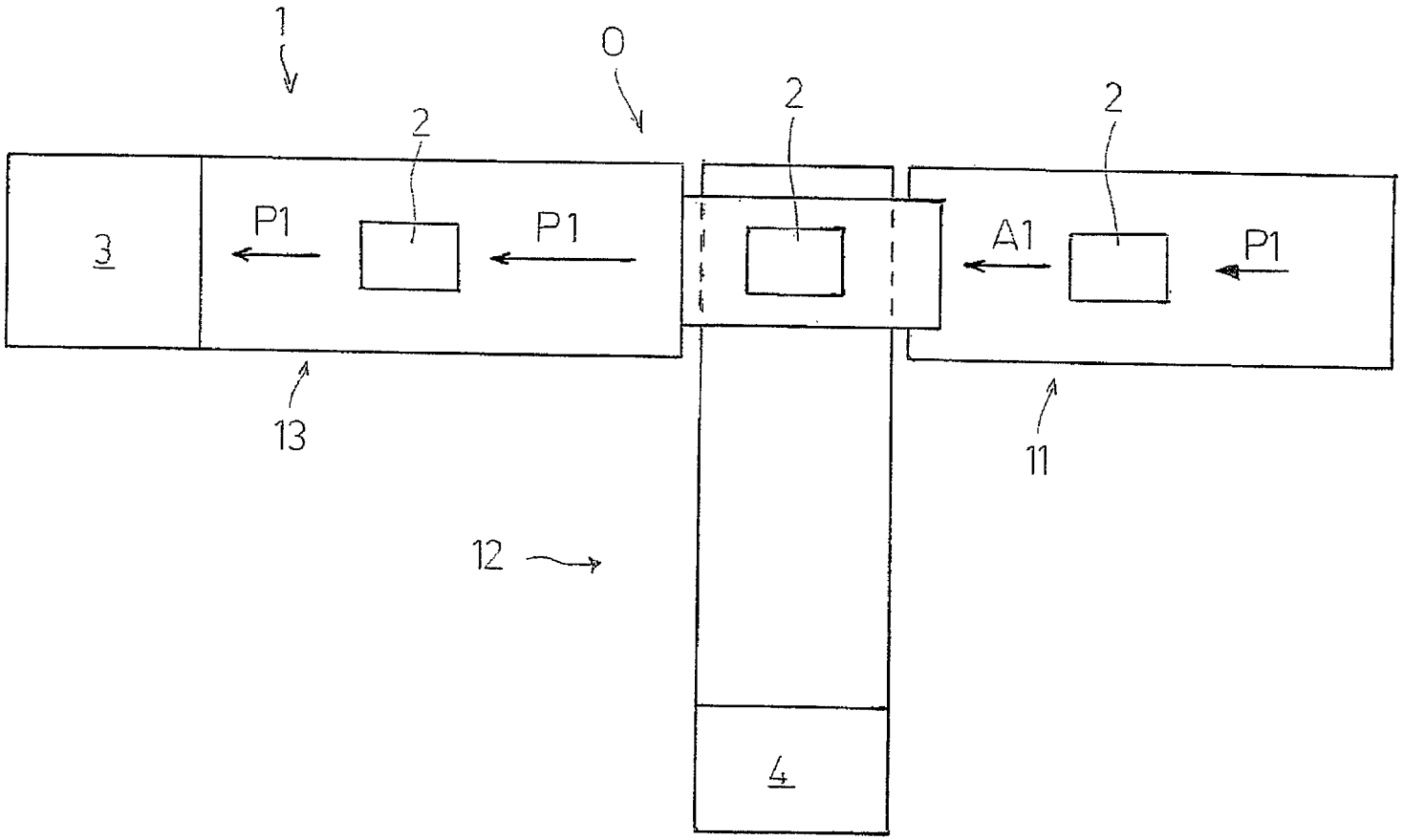
FIGS. 1 and 2 are schematic views from above of the stuffing machine according to a first embodiment of the invention, respectively in a first operating state and in a second operating state.

With reference to the accompanying figures of the drawings, (1) denotes in its entirety the stuffing machine for stuffing piles (2) of sheet articles, object of the present invention.

The envelope-stuffing (1) comprises: a stuffing machine (1) for stuffing piles (2) of sheet articles, comprising: a first conveyor (11) for moving piles (2) of sheet articles in a first advancement direction (A1); a second conveyor (12) arranged downstream of the first conveyor (11) with respect to the first advancement direction (A1), which second conveyor (12) is angularly arranged with respect to the first conveyor (11); a third conveyor (13) arranged downstream of the first conveyor (11) with respect to the first advancement direction (A1), which third conveyor (13) is aligned with the first conveyor (11) with respect to a plan view of the stuffing machine (1), is extensible in a second advancement direction (A2) opposite the first advancement direction (A1), such as to assume an operating configuration (O) in which it passes above the second conveyor (12) and defines, with the first conveyor (11), a first conveying pathway (P1) and is retractable in a same direction as the first advancing direction (A1) in order to assume an inactive configuration (I) which enables the first conveyor (11) and the second conveyor (12) to define a second conveying pathway (P2); a first stuffing unit (3) positionable along the first conveying pathway (P1) for stuffing the piles (2) of sheet articles; a second stuffing unit (4) positionable along the second conveying pathway (P2) for stuffing the piles (2) of sheet articles.

The third conveyor (13) preferably comprises: a first plurality of winding rollers (21, 22, 23); an upper belt (5) loop-wound about the first plurality of winding rollers (21, 22, 23);

a second plurality of winding rollers (24, 25, 26); a lower belt (6), loop-wound about the second plurality of winding rollers (24, 25, 26); the upper belt (5) and the lower belt (6) being arranged in such a way that a first branch (31) of the upper belt (5) and a second branch (32) of the lower belt (6) face one another such as to move a pile (2) of sheet articles in arrival from the first conveyor (11), the first branch (31) and the second branch (32) being inclined by a first angle (α) with respect to a horizontal plane.

The first plurality of winding rollers (21, 22, 23) preferably comprises a first roller (21), a second roller (22) and a third roller (23); the upper belt (5) is arranged such as to loop threadingly about the first roller (21), the second roller (22) and the third roller (23), the first roller (21), the second roller (22) and the third roller (23) are arranged such that a portion of the upper belt (5), when the upper belt (5) is activated, winds respectively about the third roller (23), the second roller (22) and the first roller (21); the first roller (21) defines the end of the first branch (31) which is proximal to the first conveyor (11); the first roller (21) and the second roller (22) are mobile in a direction that is inclined by the first angle (α) with respect to the horizontal plane.

The upper belt (5) and the first plurality of winding rollers (21, 22, 23) are preferably arranged such that: the upper belt (5) comprises a third branch (33) comprised between the first roller (21) and the second roller (22), which third branch (33) is inclined by the first angle (α) with respect to a horizontal plane; the upper belt (5) comprises a fourth branch (34) comprised between the second roller (22) and the third roller (23), which fourth branch (34) is inclined by the first angle (α) with respect to a horizontal plane; the fourth branch (34) faces the third branch (33); when the first roller (21) and the second roller (22) are moved in the first advancement direction (A1) the length of the first branch (31) diminishes and the length of the fourth branch (34) increases; when the first roller (21) and the second roller (22) are moved in the second advancement direction (A2), the length of the first branch (31) increases and the length of the fourth branch (34) diminishes.

The second plurality of winding rollers (24, 25, 26) preferably comprises a fourth roller (24), a fifth roller (25) and a sixth roller (26); the lower belt (6) is arranged such as to loop threadingly about the fourth roller (24), the fifth roller (25) and the sixth roller (26); the fourth roller (24), the fifth roller (25) and the sixth roller (26) are arranged such that a portion of the lower belt (6), when the lower belt (6) is activated, winds respectively about the sixth roller (26), the fifth roller (25) and the fourth roller (24); the fourth roller (24) defines the end of the second branch (32) which is proximal to the first conveyor (11); the fourth roller (24) and the fifth roller (25) are mobile in a direction that is inclined by the first angle (α) with respect to the horizontal plane.

The lower belt (6) and the second plurality of winding rollers (24, 25, 26) are preferably arranged such that: the lower belt (6) comprises a fifth branch (35) comprised between the fourth roller (24) and the fifth roller (25), which fifth branch (35) is inclined by the first angle (α) with respect to a horizontal plane; the lower belt (6) comprises a sixth branch (36) comprised between the fifth roller (25) and the sixth roller (26), which sixth branch (36) is inclined by the first angle (α) with respect to a horizontal plane; the sixth branch (36) faces the fifth branch (35); when the fourth roller (24) and the fifth roller (25) are moved in the first advancement direction (A1) the length of the second branch (32) diminishes and the length of the sixth branch (36) increases; when the fourth roller (24) and the fifth roller (25) are moved in the second advancement direction (A2), the length of the second branch (32) increases and the length of the sixth branch (36) diminishes.

The conveyor belt (13) is preferably of modest dimensions and has a minimum number of components necessary for carrying out the requested task of extending and retracting.

The first roller (21), the second roller (22) and the third roller (23) are preferably symmetrically arranged with respect to the fourth roller (24), the fifth roller (25) and the sixth roller (26); the plane of symmetry is aligned with the first branch (31) and the second branch (32). This symmetrical arrangement remains preferably in the operating configuration (O), in the inactive configuration (I) and in the transitory steps from a configuration to the other. The second conveyor (12) is preferably arranged at ninety degrees with respect to the first conveyor (11).

The upper branch of the second conveyor (12) and the upper branch of the first conveyor (11) are preferably arranged substantially at a same height. The first stuffing unit (3) is preferably suitable for enveloping the piles (2) of sheet articles with a strip, preferably made of card or cardboard, then to seal the strip with glue such as to envelop the piles (2) of sheet articles and to successively cut portions of the strip in order to obtain envelopes each containing a pile (2) of sheet articles.

Figure 2:
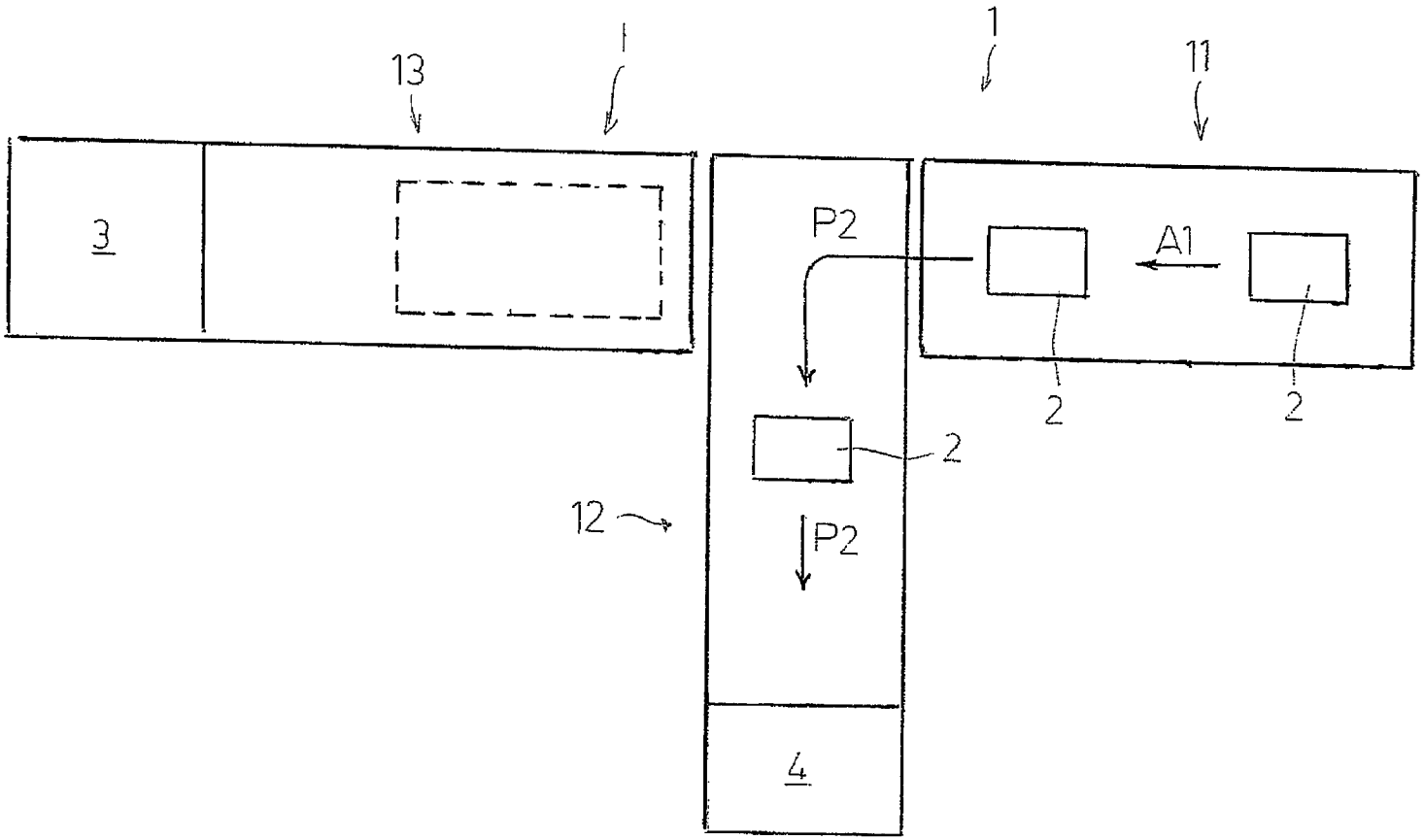
Figure 3:
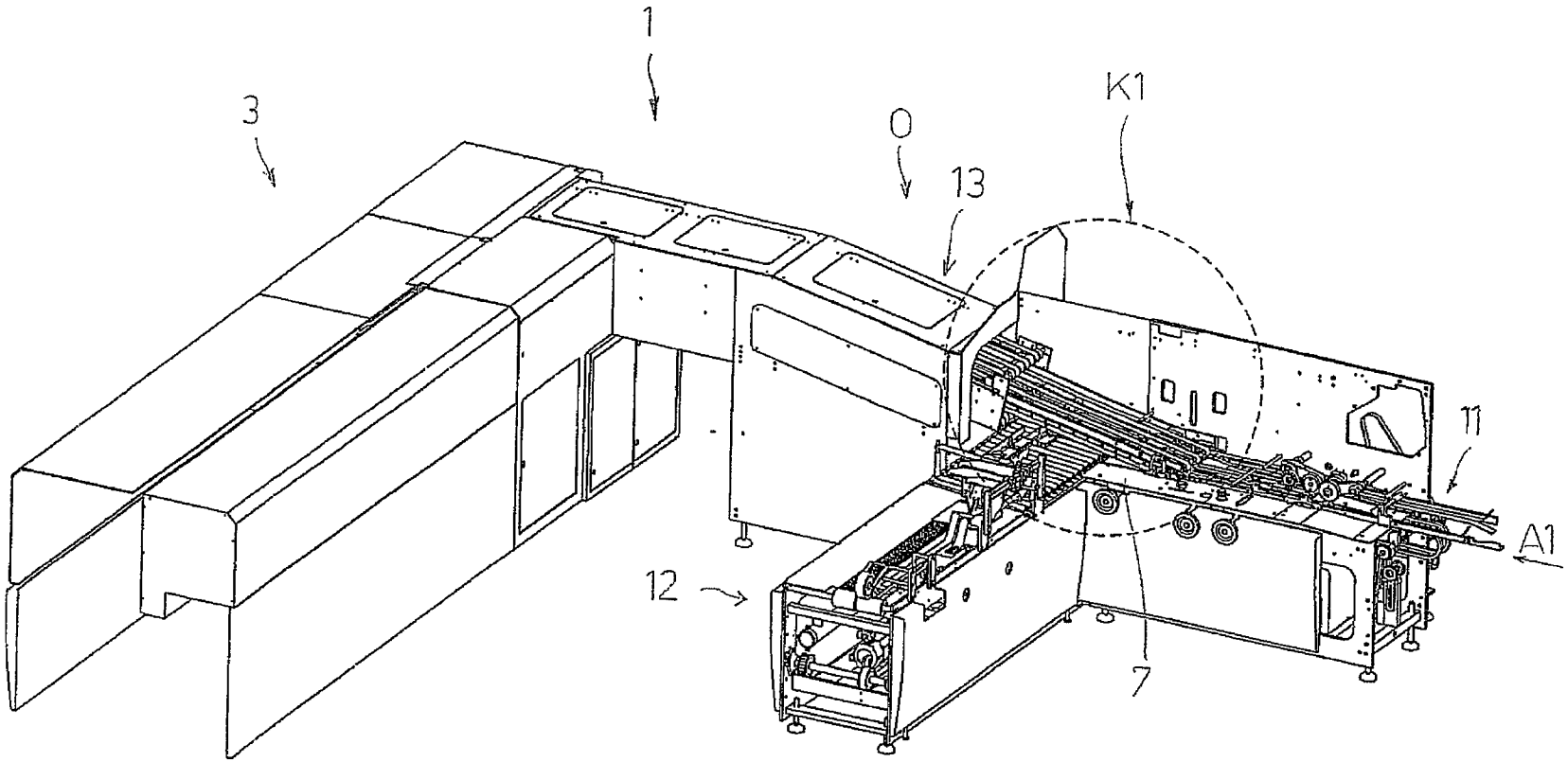
FIGS. 3 and 4 are perspective views of the stuffing machine according to a second embodiment of the invention, respectively in the first operating state and in the second operating state.
Figure 4:
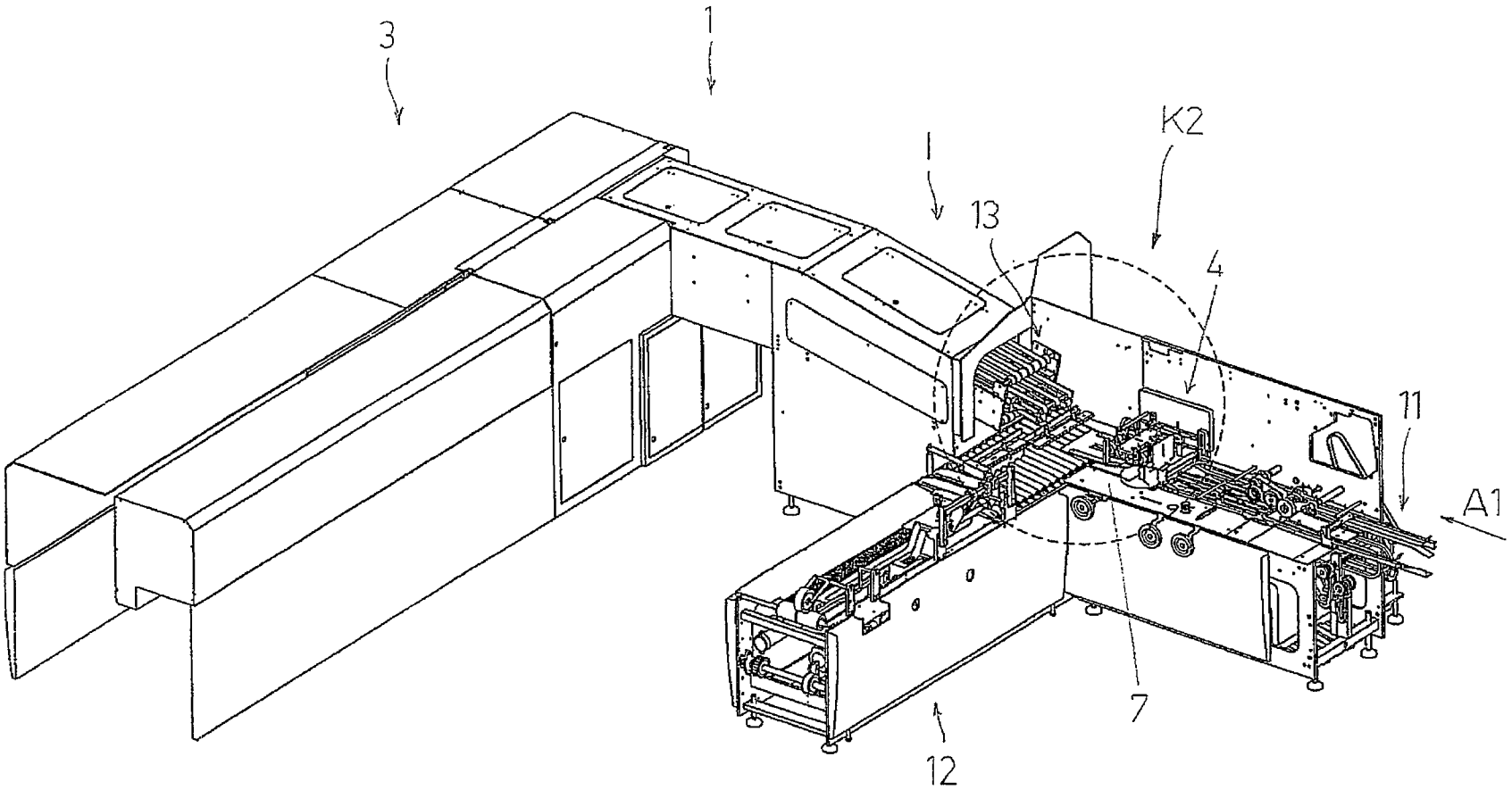
Figure 5:
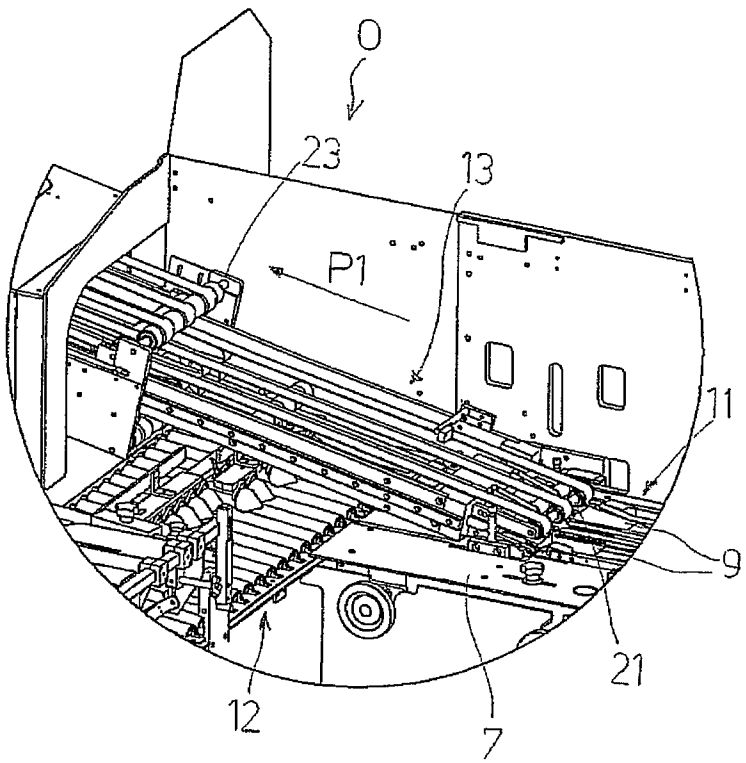
FIG. 5 is a view of enlarged detail K1 of FIG. 3.

The second stuffing unit (4) is preferably suitable for inserting the piles (2) of sheet articles in pre-formed envelopes and for sealing the envelopes. FIGS. 1 and 2 schematically and generally represent a first embodiment of the stuffing machine (1); in the illustrated example the first stuffing machine (3) is arranged downstream of the third conveyor (13) for stuffing piles (2) of sheet articles advancing along the first conveying pathway (P1); the second stuffing unit (4) is instead arranged downstream of the second conveyor (12) for stuffing piles (2) of sheet articles which are advancing along the second conveying pathway (P2).

Figures from 3 to 12 illustrate a second embodiment of the stuffing machine (1), which is described in greater detail in the following. The stuffing machine (1) comprises a support (7) which is arranged downstream of the first conveyor (11); specifically, the support (7) is comprised between the first conveyor (11) and the second conveyor (12) and is able to support the second stuffing unit (4).

The support (7) can be an integral part of the frame of the first conveyor (11).

The second stuffing unit (4) can be fixed removably to the support (7).

FIGS. 3, 5, 7, 8, 9 illustrate the stuffing machine (1) in the first operating state; in the first operating state the third conveyor (13) is in the operating configuration (O) in which it is extended and passes above the second conveyor (12) arranged at ninety degrees with respect to the first conveyor (11) and the third conveyor (13). In the first operating state the second stuffing unit (4) is removed from the support (7); because of its weight and size it can easily be handled by one or more operators with the aim of fixing or removing it from the support (7). The fourth branch (34) and the sixth branch (36) reach the minimum length thereof and the first branch (31) and the second branch (32) reach the maximum length thereof in which they pass over the second conveyor (12). A pile (2) of sheet articles is then moved by the first conveyor (11) and then by the third conveyor (13) such as to complete the first conveyor pathway (P1) and lastly to be stuffed by the first stuffing unit (3).

One or more entry portions (9) can be fixed to the frame of the first conveyor (11) (FIG. 5), which portions (9) are inclined planes for facilitating transfer of a pile (2) of sheet articles from the first conveyor (11) to the third conveyor (13) when the third conveyor (13) is in the operating configuration (O). In the example illustrated in FIGS. 3-12 the third conveyor (13) comprises a plurality of upper belts (three in number) flanked to one another and a plurality of lower belts (three in number) flanked to one another.

To bring the stuffing machine (1) from the first operating state to the second operating state it is necessary to bring the third conveyor (13) into the inactive configuration (I) thereof and fix the second stuffing unit (4) to the support (7). Then the first roller (21), the second roller (22), the fourth roller (24) and the fifth roller (25) are moved in a same direction as the first advancement direction (A1) up until the fourth branch (34) and the sixth branch (36) reach the maximum predetermined length thereof and the first branch (31) and the second branch (32) reach the predetermined minimum length thereof.

Figure 6:
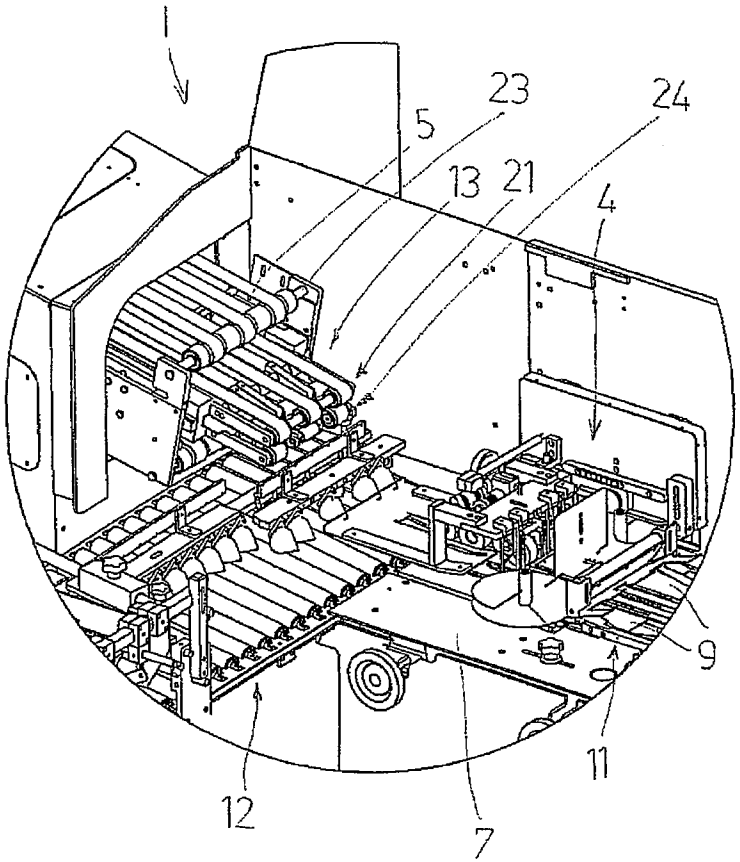
FIG. 6 is a view of enlarged detail K2 of FIG. 3.
Figure 7:
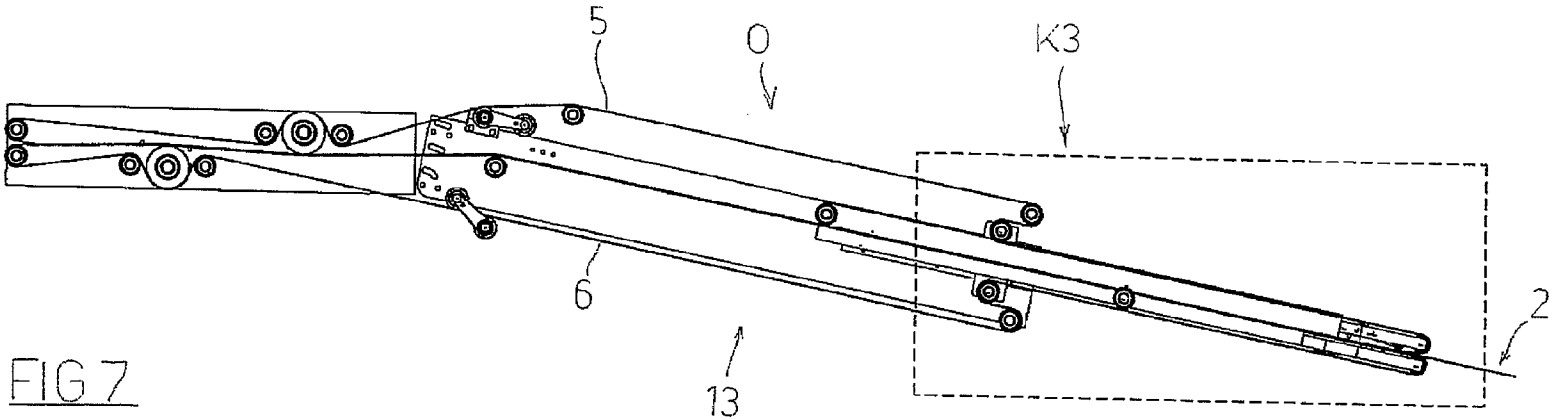
FIGS. 7, 8 are respectively a lateral view and a perspective view of the third conveyor of FIGS. 3, 4, when the machine is in the first operating state.
Figure 9:
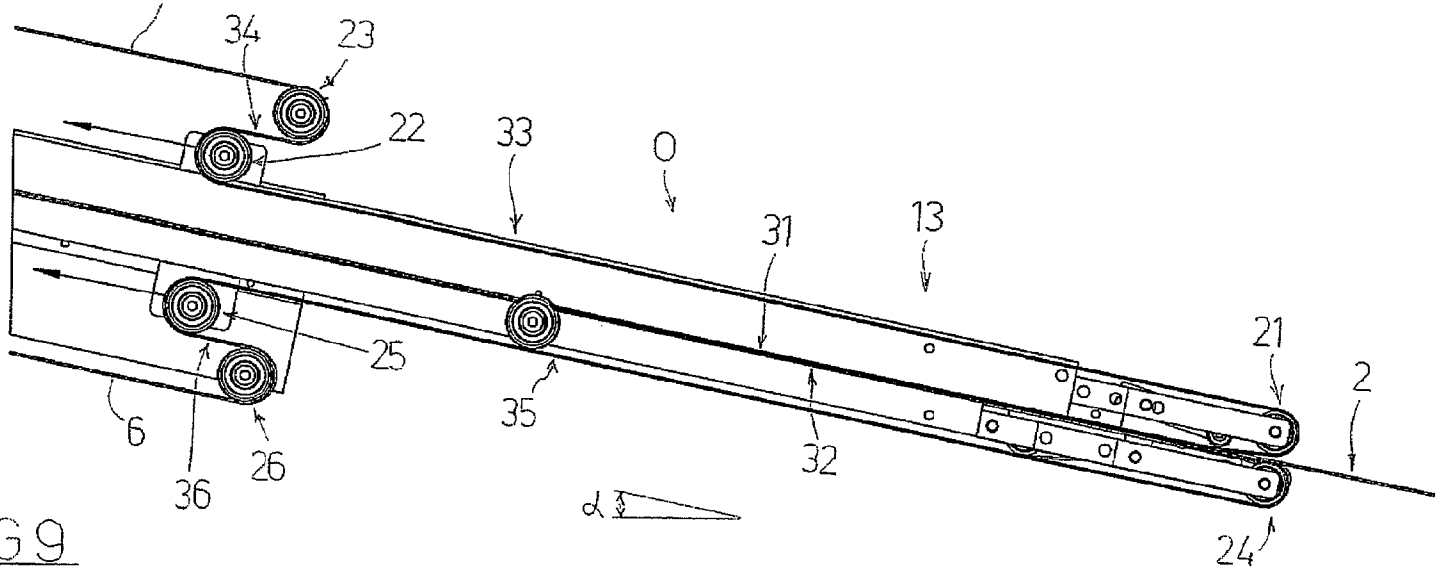
FIG. 9 is a larger-scale view of detail of K3 of FIG. 7.
Figure 11:
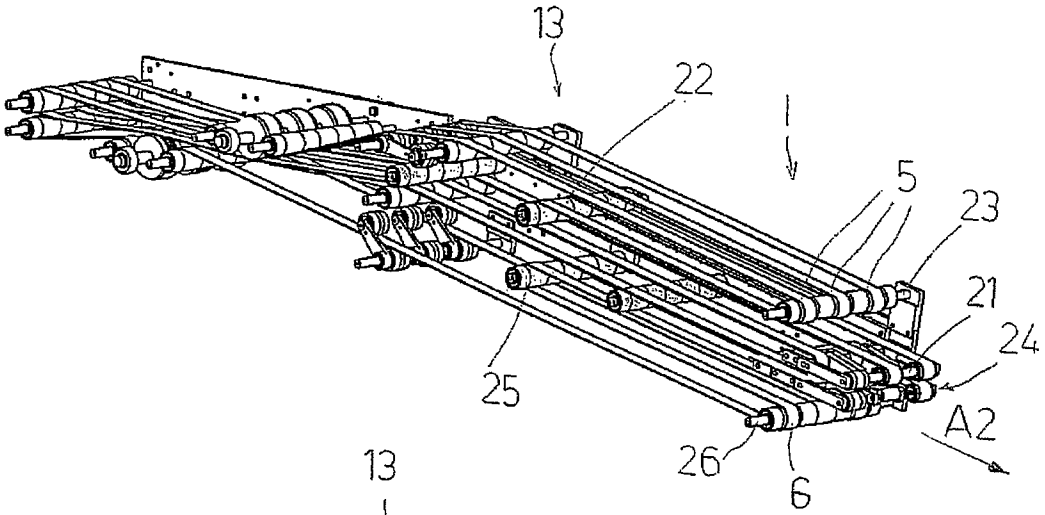
FIGS. 10, 11 are respectively a lateral view and a perspective view of the third conveyor of FIGS. 3, 4 when the machine is in the second operating state.
Figure 8:
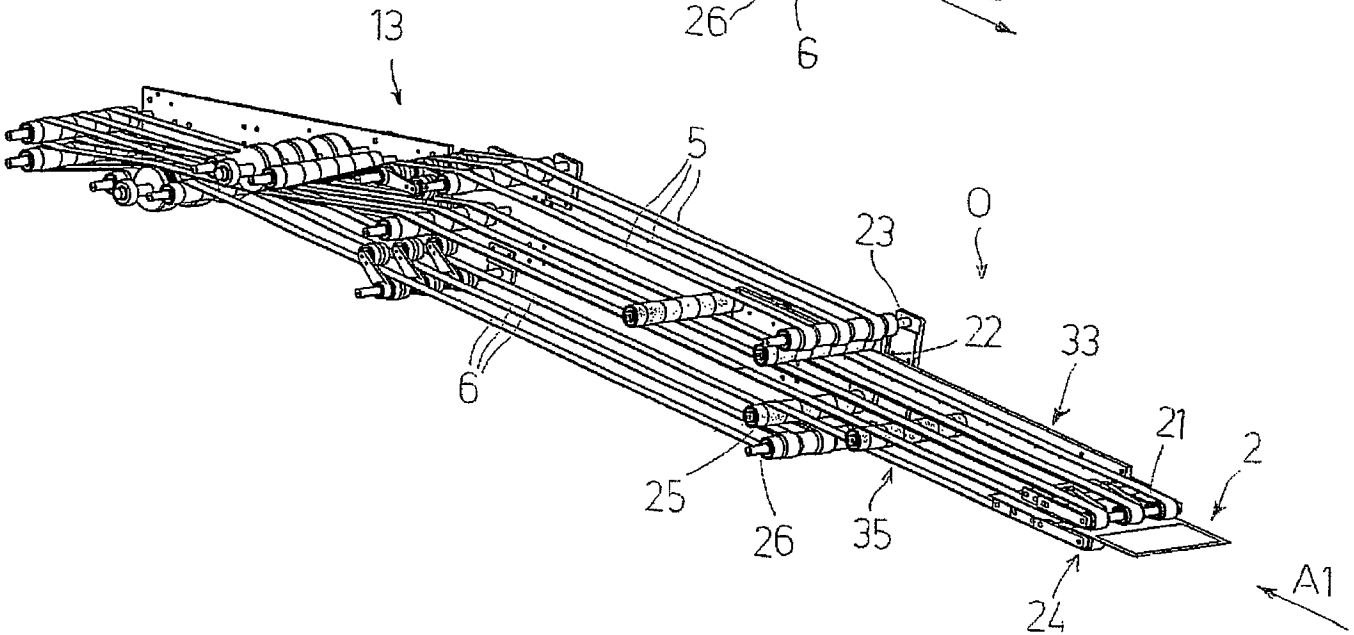
Figure 10:
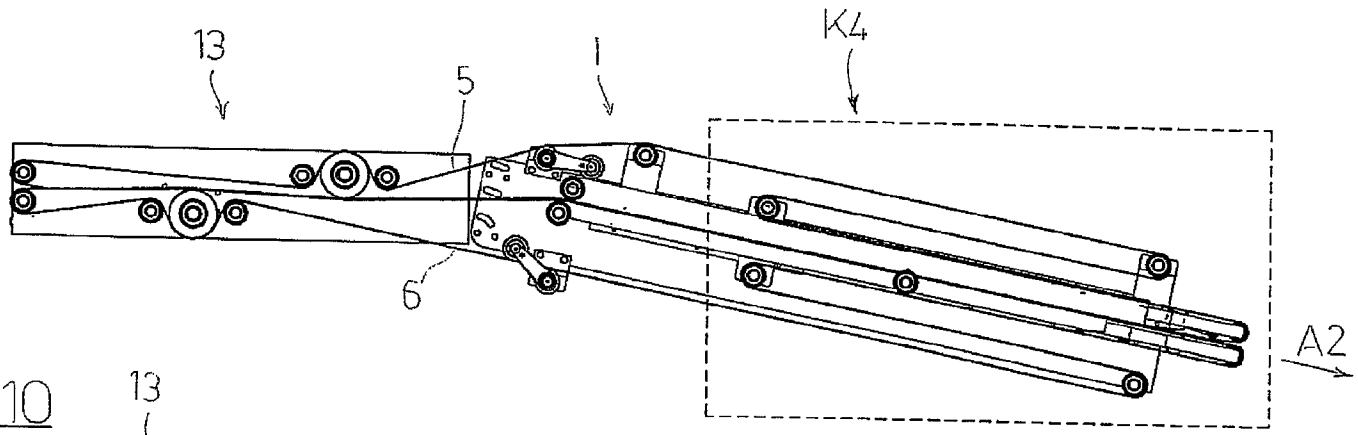
Figure 12:
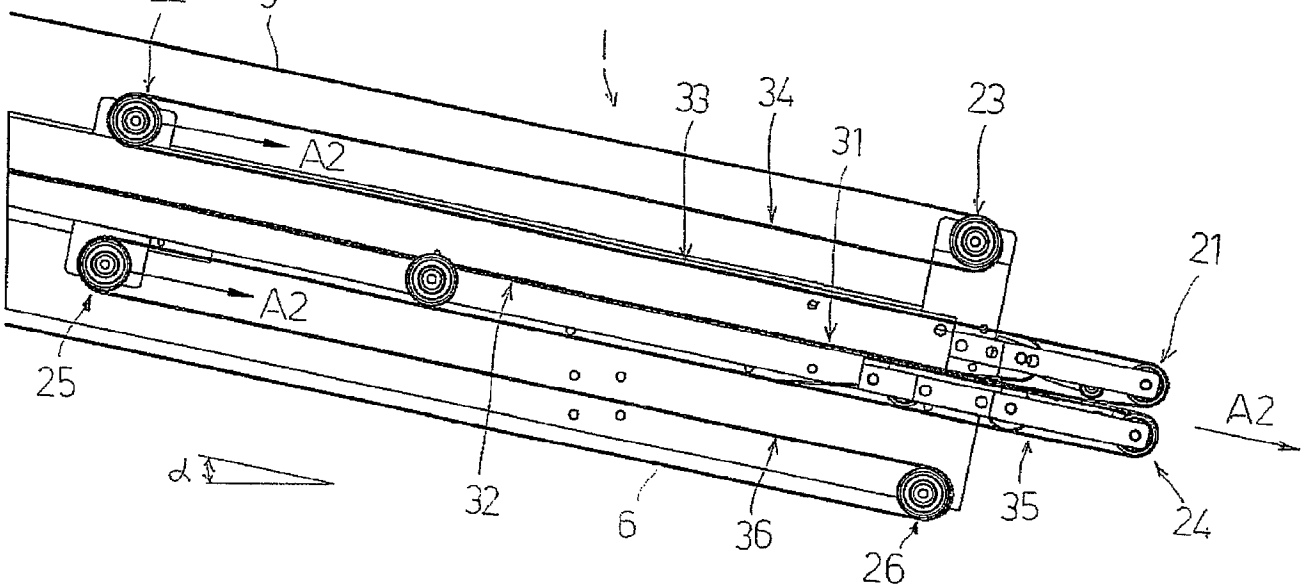
FIG. 12 is a larger-scale view of detail K4 of FIG. 10.

The entry portions (9) are preferably positioned such as to further facilitate the transfer of a pile (2) of sheet articles from the first conveyor (11) to the second stuffing unit (4) when this is fixed to the support (7) (FIG. 6).

Once the second stuffing unit (4) is fixed to the support (7), a pile (2) of sheet articles is then moved from the first conveyor (11) in inlet to the second stuffing unit (4); the second stuffing unit (4) stuffs the pile (2) of sheet articles and releases the envelope onto the second conveyor (12). See FIGS. 4, 6, 10, 11, 12.

The first conveyor (11) moves the pile (2) of sheet articles in the first advancing direction (A1) and along a horizontal advancement direction; the second conveyor (12) moves the pile (2) of sheet articles along a horizontal advancement direction and along the second conveying pathway (P2); the third conveyor (13) moves the pile (2) of sheet articles in the first advancing direction (A1), along a direction which is inclined by the first angle ($\alpha$) with respect to a horizontal plane and along the first conveying pathway (P1).

The above has been described by way of non-limiting example, and any constructional variants are understood to fall within the protective scope of the present technical solution, as claimed in the following.

The invention claimed is:

1. A stuffing machine for stuffing piles of sheet articles, comprising:

a first conveyor for moving piles of sheet articles in a first advancement direction;

a second conveyor arranged downstream of the first conveyor with respect to the first advancement direction, which second conveyor is angularly arranged with respect to the first conveyor;

a third conveyor arranged downstream of the first conveyor with respect to the first advancement direction, which third conveyor is aligned with the first conveyor, is extensible in a second advancement direction opposite the first advancement direction, such as to assume an operating configuration in which it passes above the second conveyor and defines, with the first conveyor, a first conveying pathway and is retractable in a same direction as the first advancing direction in order to assume an inactive configuration which enables the first conveyor and the second conveyor to define a second conveying pathway;

a first stuffing unit positionable along the first conveying pathway for stuffing the piles of sheet articles;

a second stuffing unit positionable along the second conveying pathway for stuffing the piles of sheet articles.

2. The machine of the claim 1, wherein the third conveyor comprises: a first plurality of winding rollers; an upper belt loop-wound about the first plurality of winding rollers; a second plurality of winding rollers; a lower belt, loop-wound about the second plurality of winding rollers; the upper belt and the lower belt being arranged in such a way that a first branch of the upper belt and a second branch of the lower belt face one another such as to move a pile of sheet articles in arrival from the first conveyor, the first branch and the second branch being inclined by a first angle with respect to a horizontal plane.

3. The machine of the claim 2, wherein: the first plurality of winding rollers comprises a first roller, a second roller and a third roller; the upper belt is arranged such as to loop threadingly about the first roller, the second roller and the third roller; the first roller, the second roller and the third roller are arranged such that a portion of the upper belt, when the upper belt is activated, winds respectively about the third roller, the second roller and the first roller; the first roller defines the end of the first branch which is proximal to the first conveyor; the first roller and the second roller are mobile in a direction that is inclined by the first angle with respect to the horizontal plane.

4. The machine of the claim 3, wherein the upper belt and the first plurality of winding rollers are arranged such that: the upper belt comprises a third branch comprised between the first roller and the second roller, which third branch is inclined by the first angle with respect to a horizontal plane; the upper belt comprises a fourth branch comprised between the second roller and the third roller, which fourth branch is inclined by the first angle with respect to a horizontal plane; the fourth branch faces the third branch; when the first roller and the second roller are moved in the first advancement direction the length of the first branch diminishes and the length of the fourth branch increases; when the first roller and the second roller are moved in the second advancement direction, the length of the first branch increases and the length of the fourth branch diminishes.

5. The machine of claim 2, wherein: the second plurality of winding rollers comprises a fourth roller, a fifth roller and a sixth roller; the lower belt is arranged such as to loop threadingly about the fourth roller, the fifth roller and the sixth roller; the fourth roller, the fifth roller and the sixth roller are arranged such that a portion of the lower belt, when the lower belt is activated, winds respectively about the sixth roller, the fifth roller and the fourth roller; the fourth roller defines the end of the second branch which is proximal to the first conveyor; the fourth roller and the fifth roller are mobile in a direction that is inclined by the first angle with respect to the horizontal plane.

6. The machine of the claim 5, wherein the lower belt and the second plurality of winding rollers are arranged such that: the lower belt comprises a fifth branch comprised between the fourth roller and the fifth roller, which fifth branch is inclined by the first angle with respect to a horizontal plane; the lower belt comprises a sixth branch comprised between the fifth roller and the sixth roller, which sixth branch is inclined by the first angle with respect to a horizontal plane; the sixth branch faces the fifth branch; when the fourth roller and the fifth roller are moved in the first advancement direction the length of the second branch diminishes and the length of the sixth branch increases; when the fourth roller and the fifth roller are moved in the second advancement direction, the length of the second branch increases and the length of the sixth branch diminishes.

7. The machine of claim 1, wherein the second conveyor is arranged at ninety degrees with respect to the first conveyor.

8. The machine of claim 1, wherein an upper branch of the second conveyor and an upper branch of the first conveyor are arranged substantially at a same height.

9. The machine of claim 1, wherein the first stuffing unit is suitable for enveloping the piles of sheet articles with a strip, then to seal the strip with glue such as to envelop the piles of sheet articles and to successively cut portions of the strip in order to obtain envelopes each containing a pile of sheet articles.

10. The machine of claim 1, wherein the second stuffing unit is suitable for inserting the piles of sheet articles in pre-formed envelopes and for sealing the envelopes.

* * * * *